US012478180B2

(12) United States Patent
Klaus et al.

(10) Patent No.: US 12,478,180 B2
(45) Date of Patent: Nov. 25, 2025

(54) DEVICE FOR HOLDING, BRAKING OR ACCELERATING A MOVABLE FURNITURE PART, CLOSING SYSTEM, AND PIECE OF FURNITURE

(71) Applicant: Paul Hettich GmbH & Co. KG, Kirchlengern (DE)

(72) Inventors: Stefan Klaus, Bünde (DE); Volker Pohlmann, Herford (DE)

(73) Assignee: Paul Hettich GmbH & Co. KG, Kirchlengern (DE)

( * ) Notice: Subject to any disclaimer, the term of this patent is extended or adjusted under 35 U.S.C. 154(b) by 65 days.

(21) Appl. No.: 18/294,205

(22) PCT Filed: Aug. 9, 2022

(86) PCT No.: PCT/EP2022/072316
§ 371 (c)(1),
(2) Date: Feb. 1, 2024

(87) PCT Pub. No.: WO2023/017017
PCT Pub. Date: Feb. 16, 2023

(65) Prior Publication Data

US 2024/0341469 A1 Oct. 17, 2024

(30) Foreign Application Priority Data

Aug. 11, 2021 (DE) ..... 10 2021 120 931.5

(51) Int. Cl.
*A47B 88/473* (2017.01)
*A47B 88/46* (2017.01)

(52) U.S. Cl.
CPC ..... *A47B 88/473* (2017.01); *A47B 88/46* (2017.01)

(58) Field of Classification Search
CPC ..... A47B 88/473; A47B 88/46; A47B 88/467; A47B 88/463; E05B 65/462
See application file for complete search history.

(56) References Cited

U.S. PATENT DOCUMENTS 6,910,749 B2 * 6/2005 Mueller ..... E05C 19/022 312/334.3
8,596,729 B2 * 12/2013 Sabelli ..... E05B 17/04 70/81

(Continued)

FOREIGN PATENT DOCUMENTS

CN 102958401 B * 3/2015 ..... A47B 88/467
DE 3834721 A1 * 4/1990 ..... A47B 88/467

(Continued)

OTHER PUBLICATIONS

International Search Report in PCT/EP2022/072316, mailed Dec. 6, 2022.

(Continued)

*Primary Examiner* — Hanh V Tran
(74) *Attorney, Agent, or Firm* — Collard & Roe, P.C.

(57) ABSTRACT

A device for holding, braking or accelerating a movable furniture part includes a driver which is movable along a guide path between at least two end positions, and an activator which can be brought into engagement with the driver at a receptacle in order to hold, brake or accelerate a movable furniture part, and can be decoupled from the driver at one of the two end positions. The activator is movable through a guide in the longitudinal direction and is resiliently mounted in a direction perpendicular to the longitudinal direction via a spring element and is movable along a run-up slope on the driver in order to latch on the receptacle behind the run-up slope, wherein the activator can be pretensioned in an engagement position on the driver in the (Continued)

event of a force in the longitudinal direction towards the driver.

9 Claims, 12 Drawing Sheets

(56) References Cited

U.S. PATENT DOCUMENTS

| | | | | |
|---|---|---|---|---|
| 8,651,597 | B2 * | 2/2014 | Kimura | E05F 3/00 312/319.1 |
| 8,678,528 | B2 * | 3/2014 | Domenig | A47B 88/463 312/334.44 |
| 10,092,100 | B1 * | 10/2018 | Chen | A47B 88/40 |
| 10,139,154 | B2 * | 11/2018 | Lee | A47B 88/463 |
| 11,185,161 | B2 * | 11/2021 | Towe | B41J 29/02 |
| 11,800,930 | B2 * | 10/2023 | Garcia | A47B 88/473 |
| 2006/0279182 | A1 * | 12/2006 | Chi Ming | A47B 47/02 312/219 |
| 2010/0231107 | A1 | 9/2010 | Radusin | |
| 2013/0076218 | A1 | 3/2013 | Radusin | |
| 2016/0007749 | A1 * | 1/2016 | Brunnmayr | A47B 88/463 312/319.1 |
| 2019/0069431 | A1 * | 2/2019 | Kho | H05K 7/20172 |
| 2019/0239644 | A1 * | 8/2019 | Pohlmann | A47B 88/467 |
| 2020/0093264 | A1 * | 3/2020 | Liao | A47B 88/477 |
| 2023/0383576 | A1 | 11/2023 | Pohlmann | |

FOREIGN PATENT DOCUMENTS

| | | | | |
|---|---|---|---|---|
| DE | 202009014685 | U1 * | 6/2010 | A47B 88/463 |
| DE | 10 2009 003 362 | A1 | 7/2010 | |
| DE | 202009005119 | U1 * | 12/2010 | A47B 88/463 |
| DE | 102010036903 | B4 * | 9/2020 | A47B 88/463 |
| DE | 10 2020 127 404 | A1 | 4/2022 | |
| EP | 2401941 | A1 * | 1/2012 | A47B 88/467 |
| EP | 2407057 | A1 * | 1/2012 | A47B 88/457 |
| EP | 2194810 | B1 * | 9/2012 | A47B 88/467 |
| EP | 3606381 | B1 * | 8/2021 | A47B 88/463 |
| WO | WO-2011147734 | A1 * | 12/2011 | A47B 88/70 |
| WO | WO-2012084593 | A1 * | 6/2012 | A47B 88/463 |
| WO | WO-2014056763 | A1 * | 4/2014 | A47B 88/493 |
| WO | WO-2015158766 | A1 * | 10/2015 | E05F 5/003 |
| WO | WO-2020152346 | A1 * | 7/2020 | B60N 2/773 |

OTHER PUBLICATIONS

German Search Report dated Jun. 22, 2022 in German Application No. 10 2021 120 931.5, with English translation of relevant parts.

* cited by examiner

Fig. 16
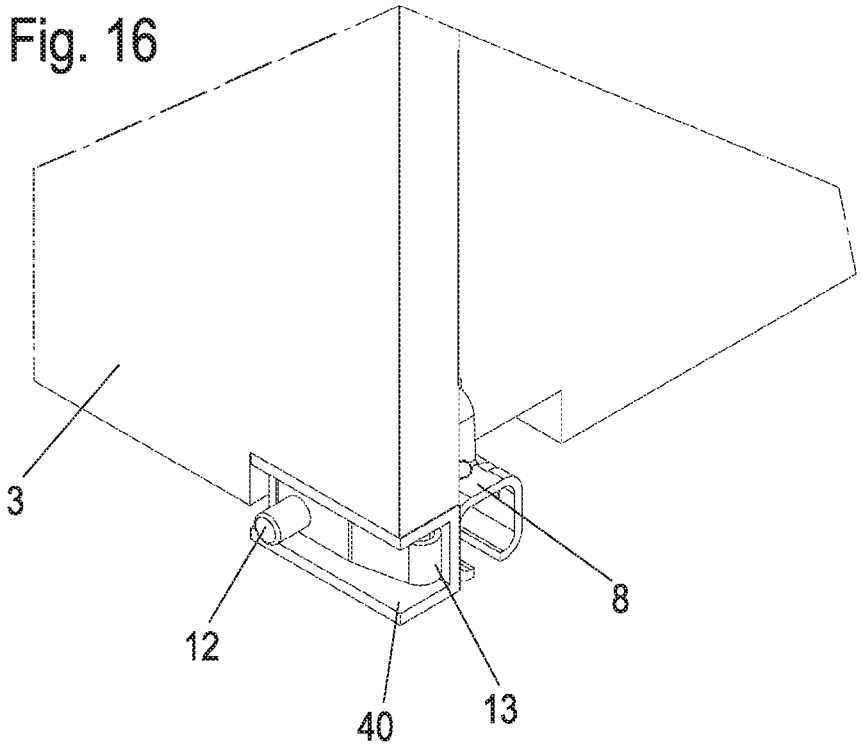
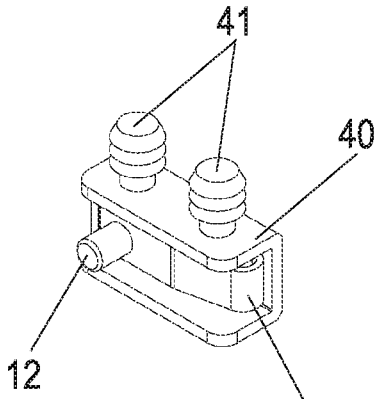
Fig. 17A
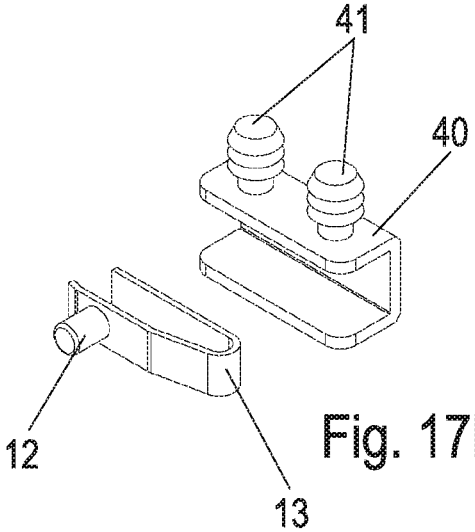
Fig. 17B

DEVICE FOR HOLDING, BRAKING OR ACCELERATING A MOVABLE FURNITURE PART, CLOSING SYSTEM, AND PIECE OF FURNITURE

CROSS REFERENCE TO RELATED APPLICATIONS

This application is the National Stage of PCT/EP2022/072316 filed on Aug. 9, 2022, which claims priority under 35 U.S.C. § 119 of German Application No. 10 2021 120 931.5 filed on Aug. 11, 2021, the disclosure of which is incorporated by reference. The international application under PCT article 21 (2) was not published in English.

The present invention relates to a device for holding, braking or accelerating a movable furniture part, having a driver which can be moved along a guide path between at least two end positions, and an activator which can be brought into engagement with the driver at a receptacle in order to hold, brake or accelerate a movable furniture part, and can be decoupled from the driver at one of the two end positions, wherein the activator can be moved through a guide in the longitudinal direction and is resiliently mounted in a direction perpendicular to the longitudinal direction via a spring element and can be moved along a run-up slope on the driver in order to latch onto the receiver behind the run-up slope, a locking system and a piece of furniture.

EP 2 194 810 B1 discloses a pull-out guide with a self-retracting device, in which an activator is arranged on a closing plug of a movable slide rail, which can be brought into engagement with a driver of a self-retracting device. The activator is connected to the plug via a web and is designed to be flexible so that, in the event of a malfunction, the activator can be deflected along a run-up slope of the driver perpendicular to the longitudinal direction in order to then latch onto a receptacle of the driver. If the driver has inadvertently reached an end position, the movable furniture part can be re-coupled with the driver. A disadvantage of this activator, however, is that in the coupled position, if the activator exerts a higher tensile force on the driver, it can be removed from the holder on the driver. This can lead to unintentional unlocking, especially if the movable furniture part is to be locked.

DE 10 2020 127 404 discloses a locking device for movable furniture parts, which ensures that only one movable furniture part of a plurality of movable furniture parts can be moved from the closed position to an open position. For this purpose, each movable furniture part is connected to a pin-shaped activator that can be locked to a locking element. The locking elements are movable on a strip perpendicular to a pull-out direction, and the distance between the locking elements must be adapted to the movable furniture parts. A resilient mounting of the activator is not provided.

It is therefore the object of the present invention to provide a device for holding, braking or accelerating a movable piece of furniture which, with a resiliently mounted activator, enables simple engagement on a driver and provides high holding forces when locked.

This object is solved by a device with the features of claim 1.

In the device according to the invention, the activator is held in an engagement position on the driver in such a way that, when a force is applied in the longitudinal direction, the activator can be preloaded towards the driver, i.e. the engagement forces increase. As a result, the activator is coupled to the driver in a self-reinforcing manner, i.e. a load caused by a force in the longitudinal direction leads to a pretensioning of the activator towards the driver, so that the coupling between driver and activator can withstand high holding forces.

Preferably, with an increasing force, in particular a tensile force on the activator in the longitudinal direction, the spring element biases the activator more strongly towards the driver, so that unintentional release of the activator from the driver is prevented.

In a preferred embodiment, the activator can be moved from an initial position with a relaxed spring element perpendicular to the longitudinal direction in opposite directions. As a result, the activator can be pressed in a first direction when passing over a run-up slope on the driver in order to be locked on the driver. If the activator is subjected to a tensile load in the longitudinal direction in the locked position, the activator can be moved in an opposite second direction perpendicular to the longitudinal direction via the spring element in order to press the activator into the driver. This allows the activator to be moved flexibly depending on the intended use.

Preferably, the spring element is designed as a leaf spring, and at least one leg of the leaf spring extends from the activator essentially in the longitudinal direction and against the effective direction of the force. The at least one leg can have at least one section that is aligned at an angle to the longitudinal direction. This means that when a force is applied parallel to the longitudinal direction, the leg with the activator can ensure that the activator is pressed against the driver. The leg preferably extends in the opposite direction to the direction of action, so that the leg on which the activator is arranged is subjected to pressure.

The spring element can be made of a bent sheet steel and can, for example, be web-shaped and/or U-shaped, with one end coupled to a movable furniture part, for example via a running rail of a pull-out guide or a running part of a sliding door fitting, while the other end has the activator.

In order to avoid plastic deformation of the spring element, at least one stop is preferably provided on the spring element, which limits the deflection of the leg carrying the activator on the spring element. This allows the spring element to be deflected with the stop from an initial position with a relaxed spring element only by a predetermined distance in one direction in order to avoid plastic deformation of the spring element. The stop can be integral with the spring element. It is also possible to manufacture the activator and the spring element in one piece. The activator can, for example, be designed as a cylindrical pin or embossing that can be inserted into the holder on the driver. The activator can be designed as a cylindrical, conical or rectangular element made from a solid or hollow material. The activator can be attached to the spring element in a form-fitting or material-fitting manner or be integral with it. The activator can be produced by forming a spring plate or a wire, for example as a coiled eyelet or as a projection.

The device for holding, braking or accelerating a movable furniture part can, for example, be designed as a closing system, particularly in the case of a piece of furniture with several drawers, in order to ensure that only one drawer at a time is moved from the closed position to the open position, so that when a drawer is arranged in an open position, the other drawers are secured against an opening movement. Alternatively, the device can also be used with a self-closing mechanism, for example a damped self-closing mechanism, in which the driver is pretensioned in a closing direction via a force accumulator. Furthermore, the device can also be designed as an ejection device, in which the activator is coupled to the driver in order to eject a movable furniture part from the closed position in the opening direction.

In a piece of furniture according to the invention, at least one movable furniture part is coupled to a furniture body with a device for holding, braking or accelerating the movable furniture part, in particular a drawer. The activator is preferably fixed to the movable furniture part and the driver is fixed to the furniture body. However, it is also possible to provide the activator on the furniture body and the driver on the movable furniture part. In addition, a sliding door or a movable furniture part of a household appliance can also be used as a movable furniture part.

For a compact design, a strip with several housings can be fixed to the furniture body, whereby a guide track for a driver is provided in each housing, which can be brought into engagement with an activator on a running rail on a pull-out guide or a drawer. This allows the device to be used effectively as a locking device for locking the drawers.

The invention is explained in more detail below with reference to several embodiments with reference to the accompanying drawings, whereby:

FIG. 16 shows a perspective view of an activator of a device mounted on the drawer, and FIGS. 17A and 17B show two views of the activator of the device of FIG. 16.

Figure 1:
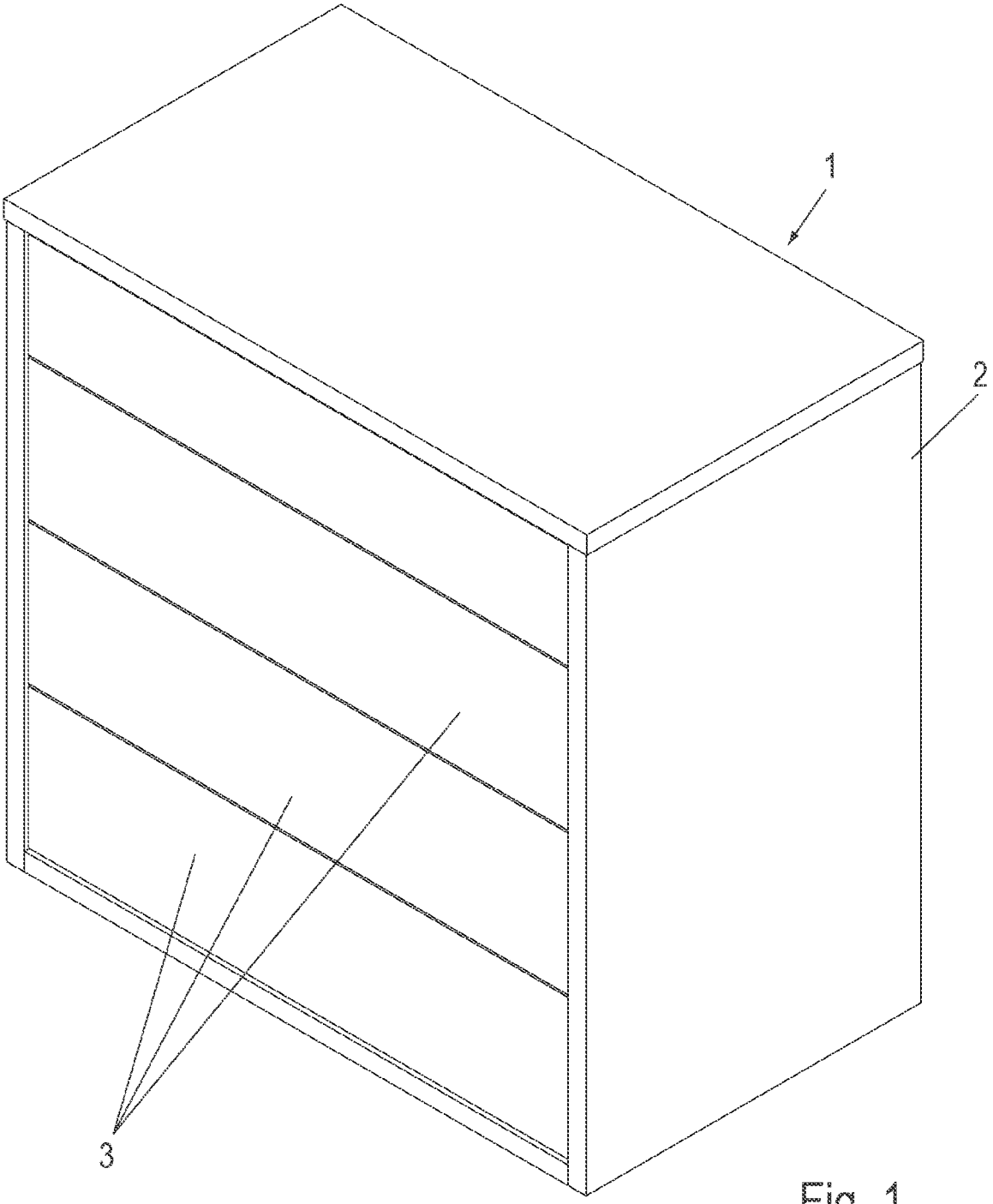
FIG. 1 shows a perspective view of a piece of furniture.
Figure 2:
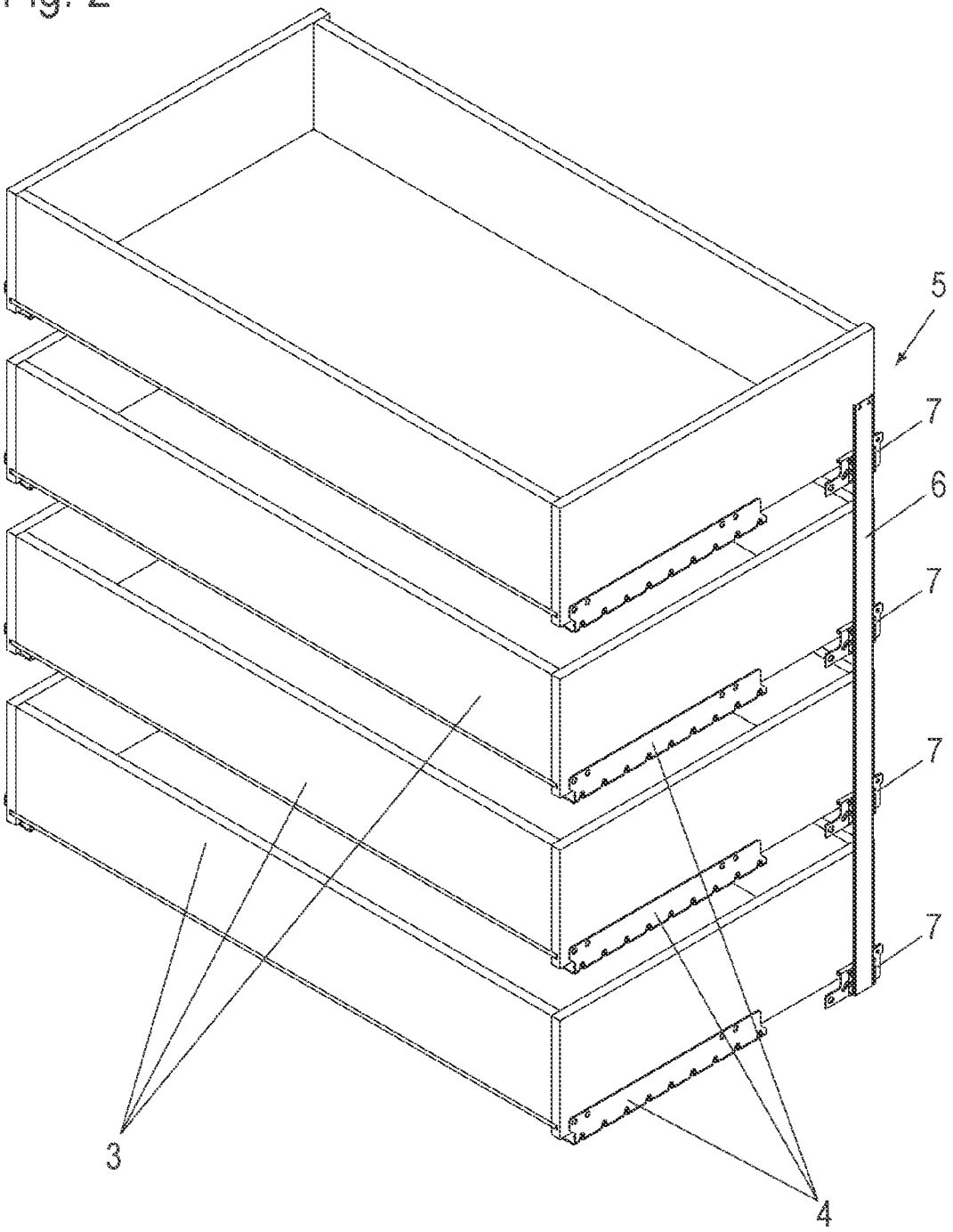
FIG. 2 shows a view of the piece of furniture in FIG. 1 without the furniture body.

A piece of furniture 1 comprises a furniture body 2 on which a plurality of drawers 3 are movably arranged. In FIG. 2, the piece of furniture 1 is shown without the furniture body 2, and it can be seen that the drawers 3 can each be moved via pull-out guides 4, which are fixed to the furniture body 2.

A device 5 for holding, braking or accelerating a drawer 3 is arranged in the furniture body, wherein in the illustrated embodiment example the device 5 is designed as a closing system, in which the device 5 holds the drawers 3 in the closed position as soon as one of the drawers 3 is arranged in an open position. The device 5 comprises a vertical strip 6, on which several housings 7 are arranged.

Figure 3:
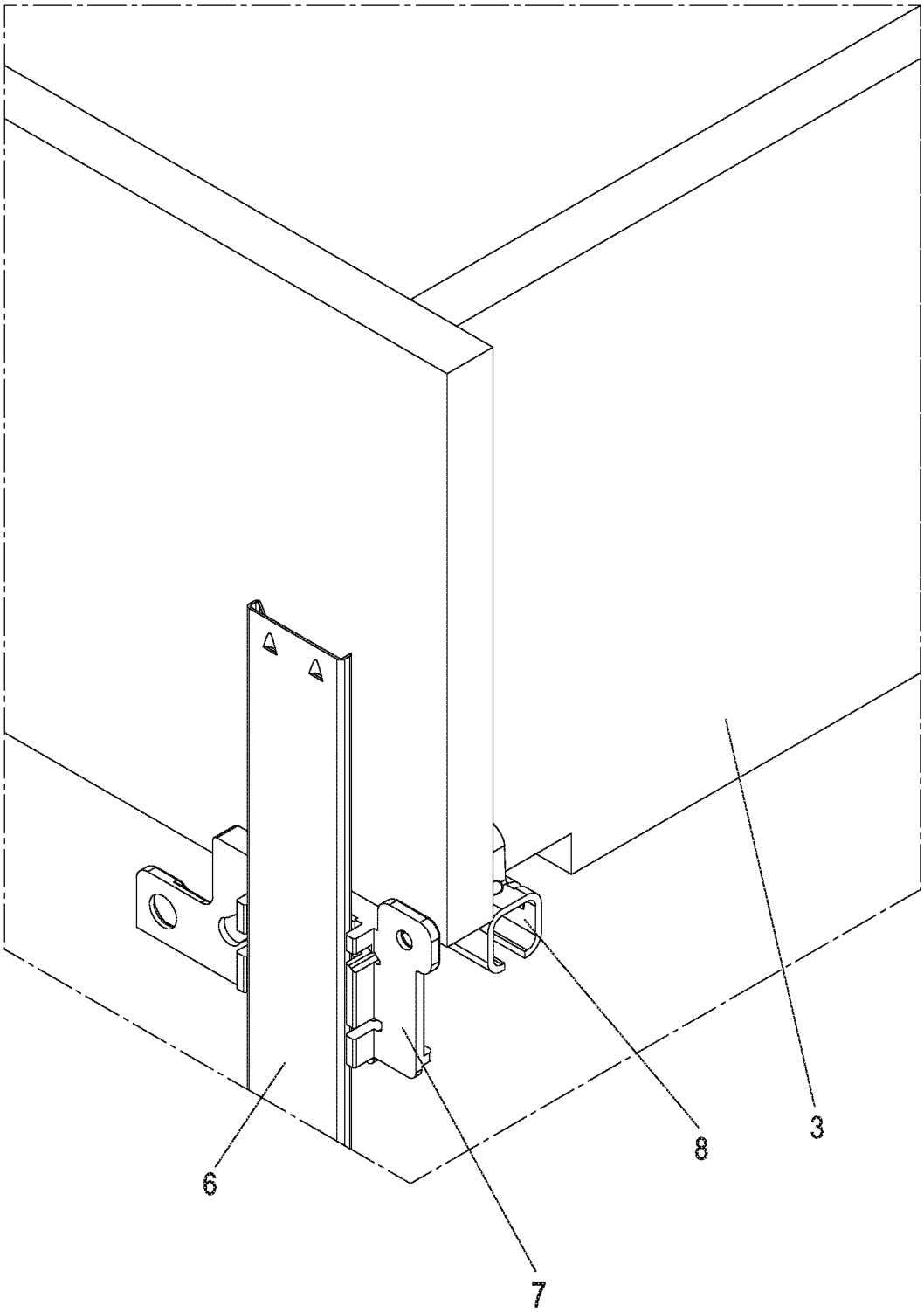
FIG. 3 shows a detailed view of a part of the device for holding, braking or accelerating a movable furniture part on the piece of furniture.

FIG. 3 shows a detailed view of a housing 7 and a drawer 3. The drawer 3 is arranged on a movable running rail 8 of a pull-out guide 4 and can be held in a closed position by the device 5.

Figure 4B:
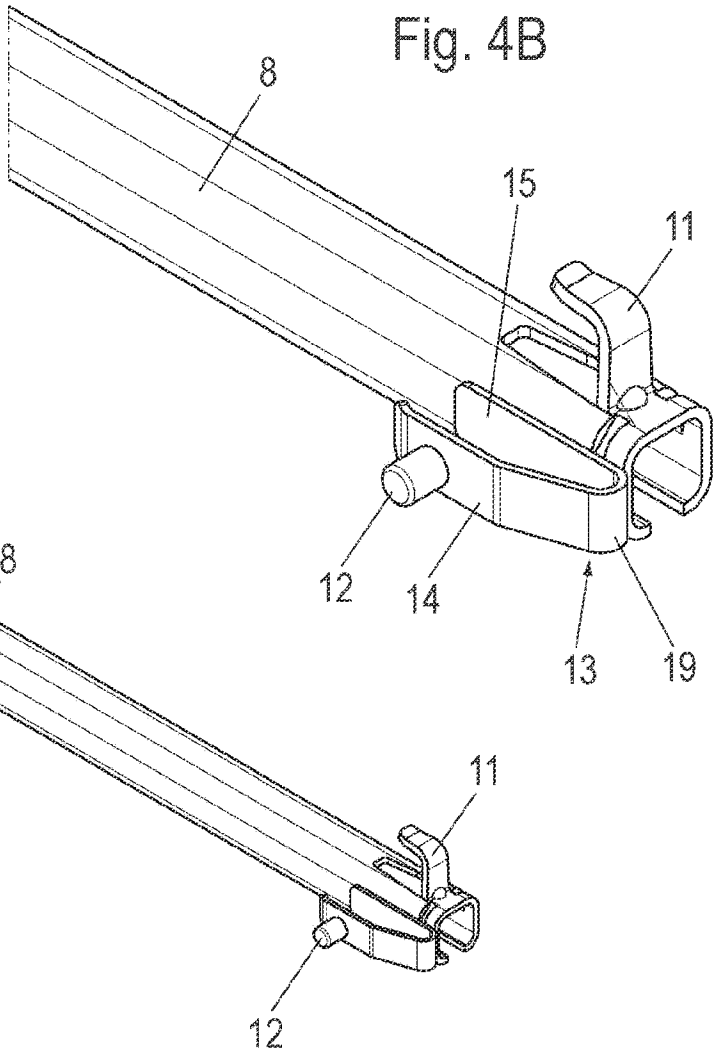
FIGS. 4A and 4B show two views of a pull-out guide for mounting the drawers of FIG. 2.
Figure 4A:
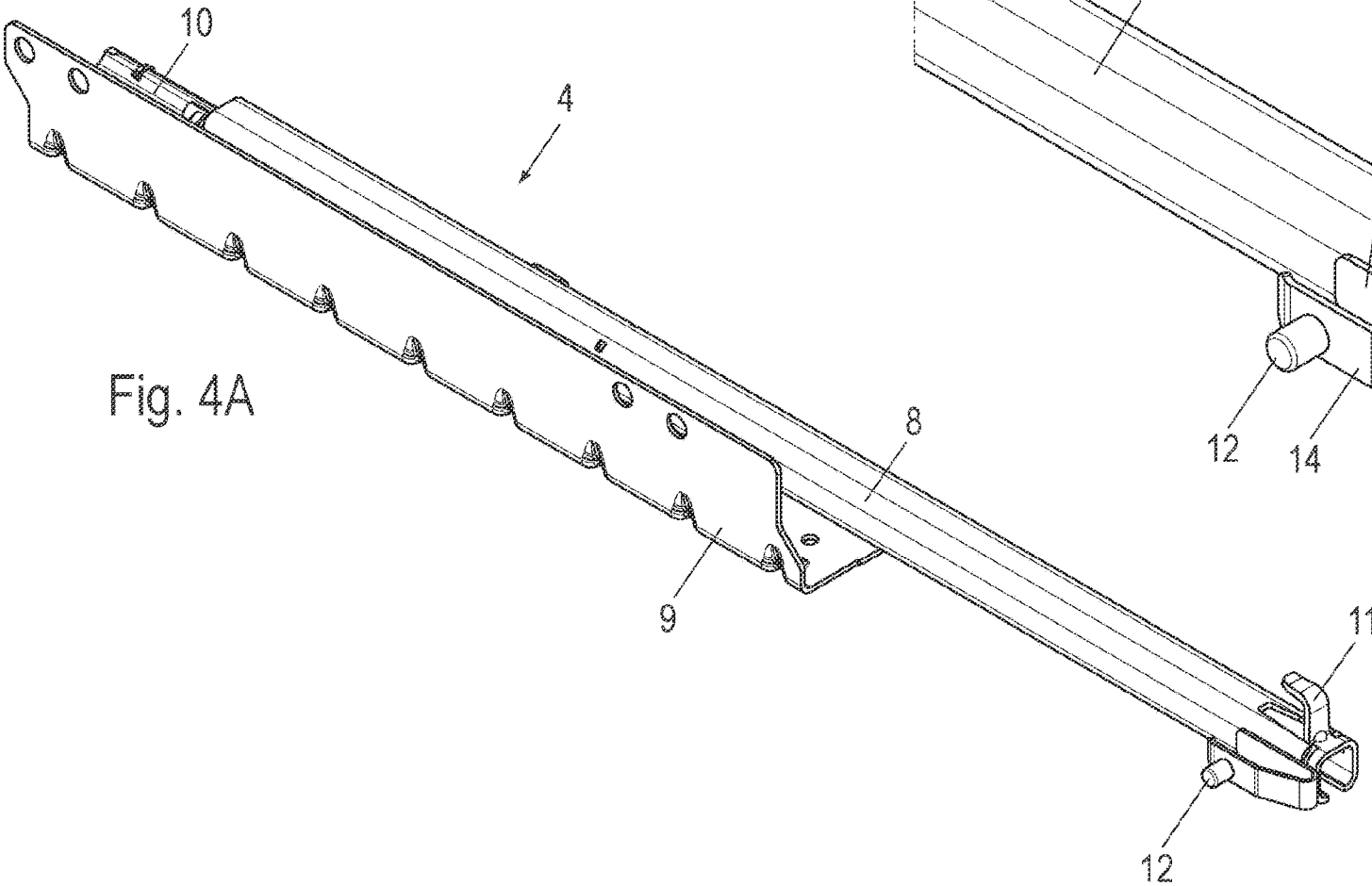

FIGS. 4A and 4B show a pull-out guide 4 that has a stationary guide rail 9 that can be fixed to the furniture body 2 and on which the movable running rail 8 is held so that it can move. Between the guide rail 9 and the running rail 8, a pull-out extending middle rail 10 is provided, which can optionally be omitted. A hook 11 is formed on the back of the running rail 8 and serves to secure the drawer 3. Adjacent to the hook 11, an activator 12 in the form of a pin is provided, which is resiliently mounted on a spring element 13. The spring element 13 is designed as a leaf spring and comprises two legs 14 and 15, which are connected to each other in an essentially U-shape via a bend 19. The activator 12 is held on the leg 14, while the leg 15 is fixed to the running rail 8, for example by welding. Depending on the design of the spring element 13, other detachable or non-detachable joining methods or material and form-fit connections can also be used.

Figure 5A:
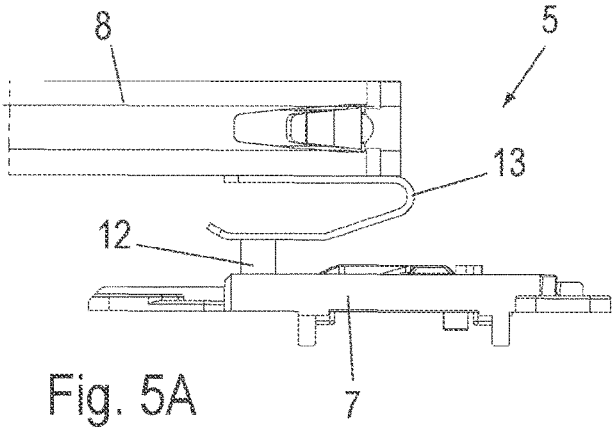
FIGS. 5 to 7 show more detailed views of the device in FIG. 3 when coupling the active door to the driver.
Figure 5B:
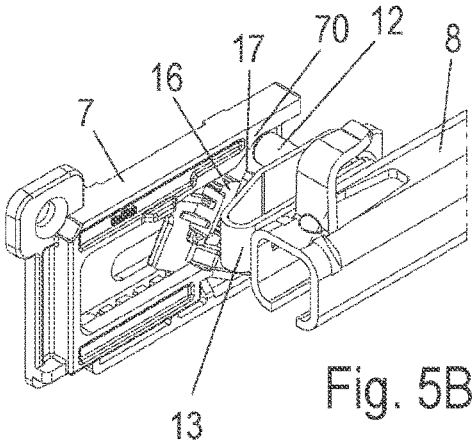

In FIGS. 5A and 5B, the device 5 is shown in a position in which the activator 12 is arranged on an input side of the housing 7 in order to be moved into a closed position. A guide track for a movable driver 16 is formed on the housing 7, which has a receptacle 17 for inserting the activator 12. The driver 16 is in a pivoted end position, and the activator 12 can move into the receptacle 17 in order to move the driver 16 from the end position along the guide track on the housing 7. The activator 12 is initially moved against a run-up slope 70 on the housing 7 and can thus raise the housing 7 slightly relative to the strip 6.

Figure 6A:
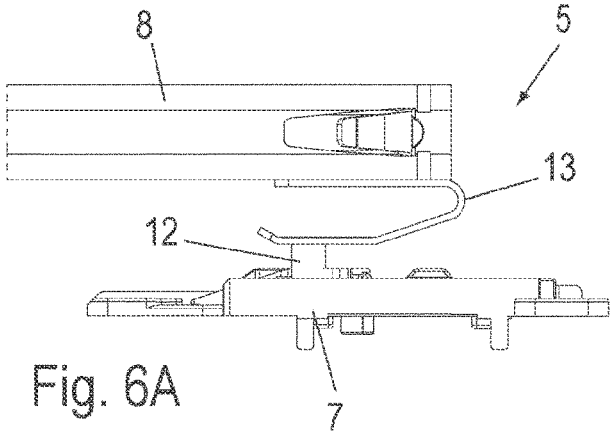
Figure 6B:
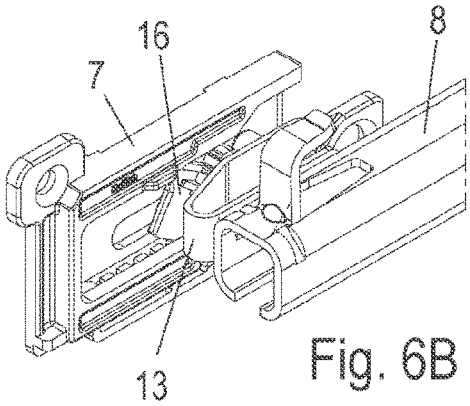

In FIGS. 6A and 6B, the activator 12 has been moved slightly further and is arranged in the receptacle 17 of the driver 16. The activator 12 can now pivot the driver 16 and move it to a second end position, which corresponds to the closed position.

Figure 7A:
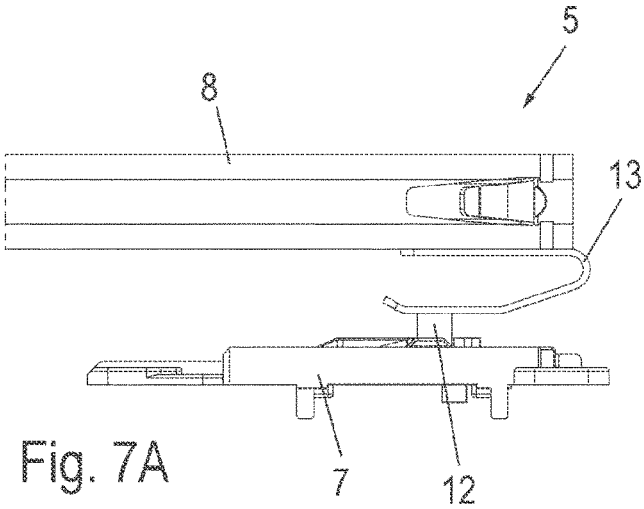
Figure 7B:
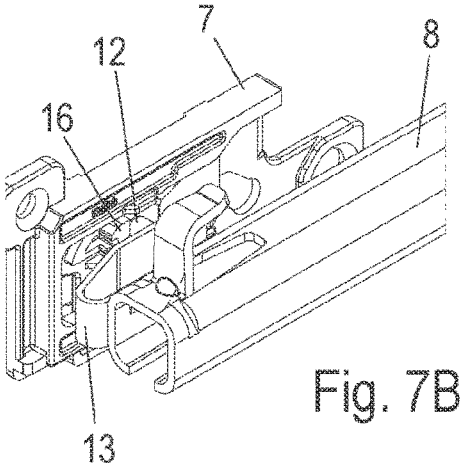

In FIGS. 7A and 7B, the activator 12 with the driver 16 is arranged in the closed position. From this position, in the unlocked position of the device 5, the drawer 3 with the running rail 8 and the activator 12 can be moved again in the opening direction, whereby the driver 16 is then moved again into the first end position as shown in FIG. 5. If the device 5 is in a locked position because another drawer 3 is arranged in the open position, the drawer shall be held in the closed position by the device 5.

Figure 8A:
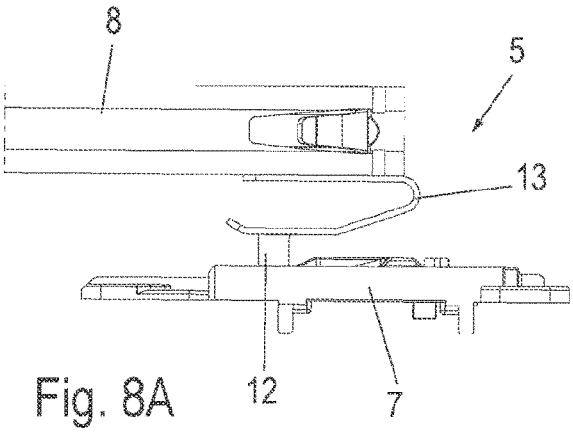
FIGS. 8 to 11 show multiple views of the device of FIG. 3 when coupling the activator to the driver when the driver is already in the closed position.
Figure 8B:
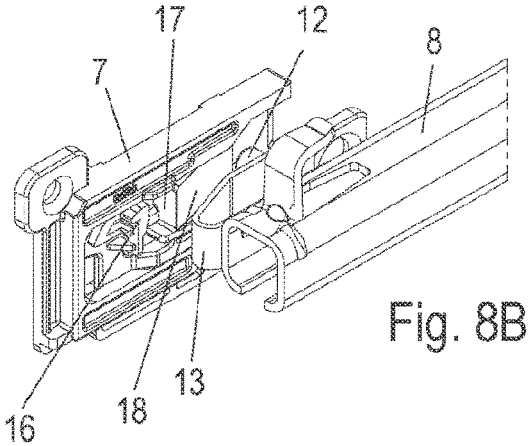
Figure 9A:
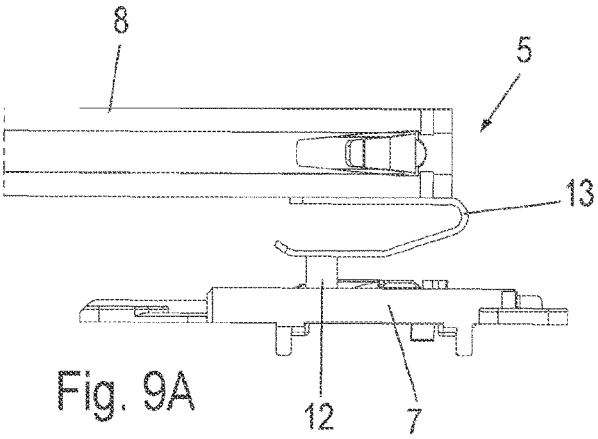
Figure 9B:
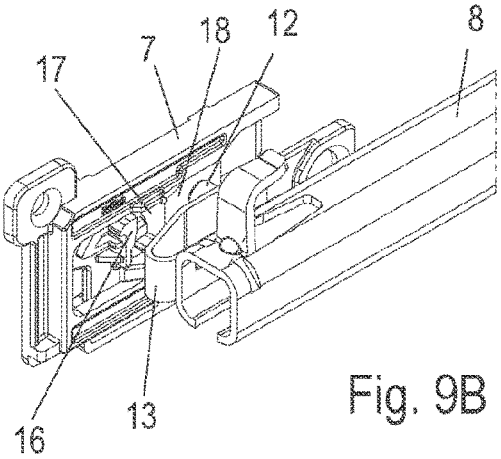

FIGS. 8A and 8B show a position in which the driver 16 is already arranged in the closed position, while the running rail 8 and the activator 12 are arranged in an open position. This can occur, for example, due to incorrect actuation or during the assembly of the drawers 3. In order to nevertheless enable the activator 12 to engage with the driver 16, a run-up slope 18 is formed on the driver 16, which is arranged at a slight angle to the longitudinal direction of the running rail 8. The activator 12 is moved further with the running rail 8 in the closing direction, as shown in FIGS. 9A and 9B, so that the activator 12 comes to rest with an end edge against the run-up slope 18 and is then moved perpendicular to the longitudinal direction against the force of the spring element 13.

Figure 10A:
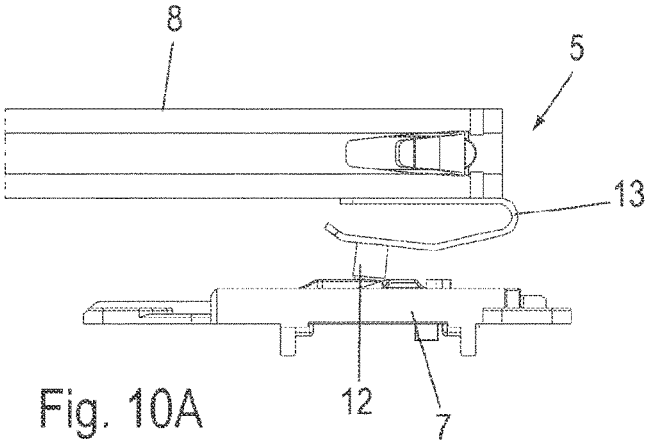
Figure 10B:
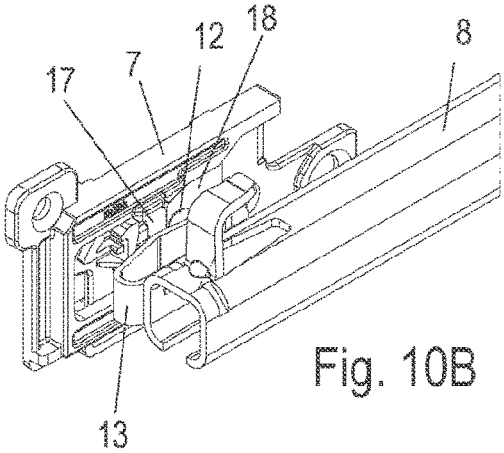
Figure 11A:
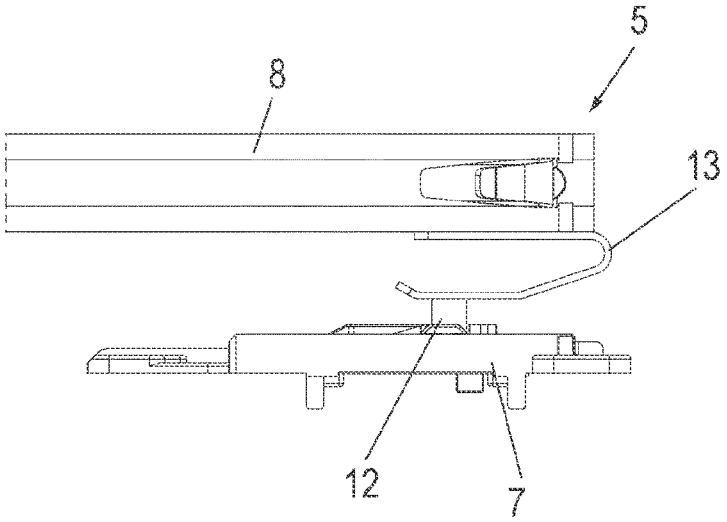
Figure 11B:
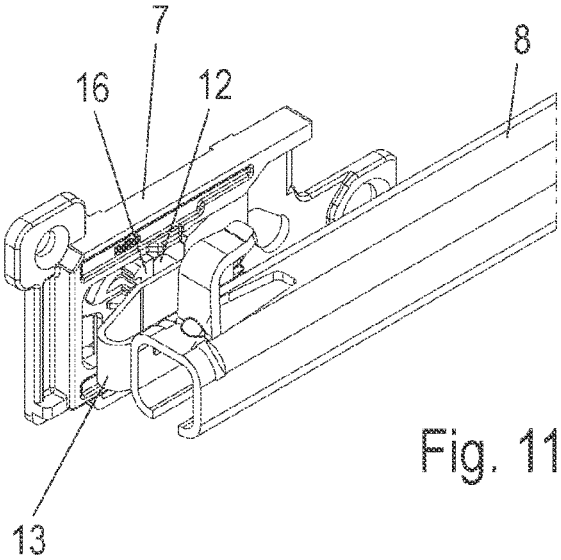

As shown in FIGS. 10A and 10B, the activator 12 has been moved perpendicular to the longitudinal direction of the running rail 8, whereby the spring element 13 is moved together. As a result, the activator 12 moves towards the running rail 8 and can thus be moved along the run-up slope 18. The activator 12 then enters the receptacle 17 on the driver 16 behind the run-up slope 18, as shown in FIGS. 11A and 11B. The activator 12 can thus be engaged on the driver 16 and now move it again in the opening direction along the guide track if required.

Figure 12A:
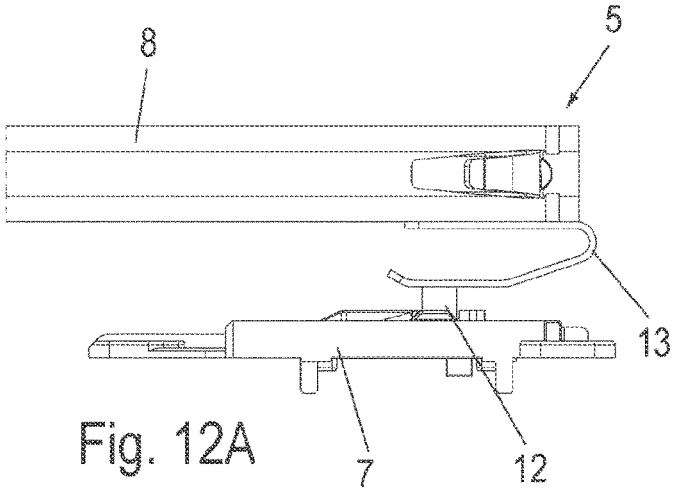
FIGS. 12 to 14 show several views of the device of FIG. 3 when the drawer is locked in the closed position by the device and a pulling force is applied.
Figure 12B:
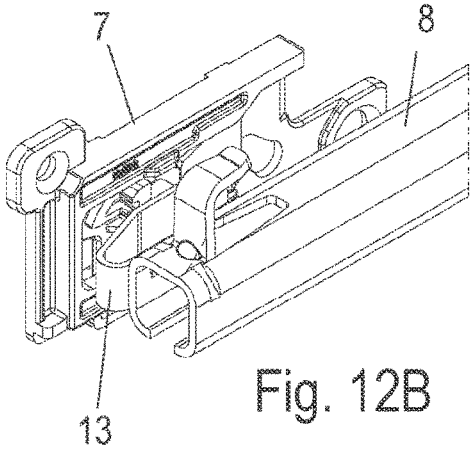

In FIGS. 12A and 12B, the device 5 is again shown in a closed position, in which the activator 12 is inserted on the spring element 13 in the receptacle 17 of the driver 16. The device 5 shall now lock the activator 12 because another drawer 3 of the piece of furniture 1 is already arranged in an open position.

Figure 13A:
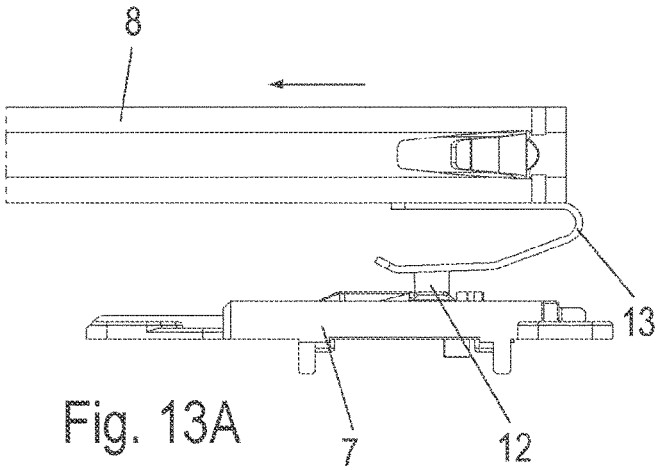
Figure 13B:
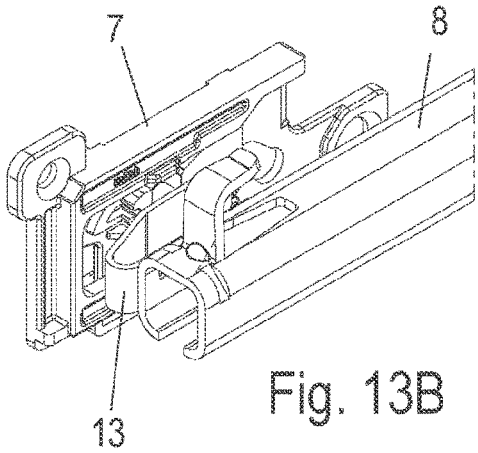
Figure 14A:
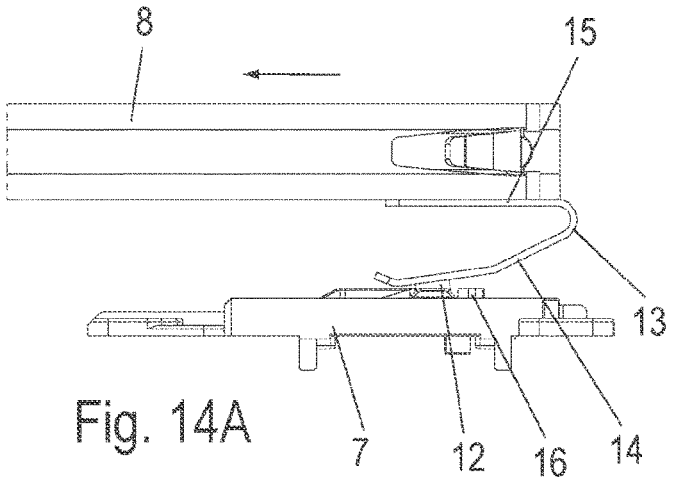
Figure 14B:
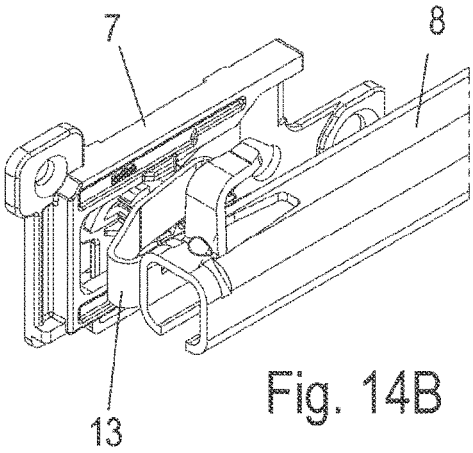

If a force is now exerted on the drawer 3 in the opening direction, i.e. in the longitudinal direction of the running rail 8 as shown by the arrow in FIG. 13A, the spring element 13 presses on the activator 12, which is prevented from opening by the driver 16. For this purpose, the housing 7 can be moved vertically along the strip 6, or a locking element can block the movement of the driver 16. If the force on the running rail 8 is increased, the position shown in FIGS. 14A and 14B is obtained. The activator 12 is pressed towards the driver 16 by the spring element 13, as the running rail 8 in FIG. 14A is pulled to the left and the spring element 13 attempts to spread open. This further increases the engagement of the activator 12 with the driver 16 and thus enables high holding forces to be provided for secure locking of the drawer 3. The leg 14, which in the relaxed position has a section parallel to the longitudinal direction and a section inclined to the longitudinal direction, for example at an angle of between 5° and 15°, is subjected to pressure and presses the activator 12 against the driver 16.

The activator 12 can thus be moved from the relaxed position of the spring element 13 perpendicular to the longitudinal direction of the running rail 8, once to pass over the run-up slope 18 (FIG. 10A), whereby the activator 12 is then moved towards the running rail 8, and once in the opposite direction (FIG. 14A), whereby the activator 12 is then moved towards the driver 16.

Figure 15A:
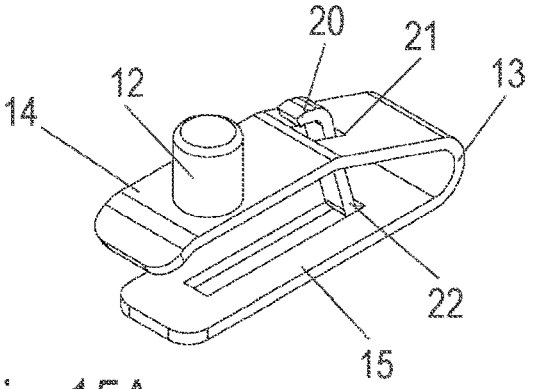
FIGS. 15A to 15T show several views of different embodiments of an activator with a spring element.

FIG. 15A shows an embodiment example of an activator 12 on a spring element 13, which is designed as in the previous embodiment example, wherein the spring element 13 has a first leg 14 for fixing the activator 12 and a second leg 15 for fixing it to a running rail 8. In addition, the spring element 13 has a stop 20 to limit the movement of the activator 12 at least outwards, i.e. towards the driver 16. The stop 20 is formed on an angled web 22, which extends through an opening 21 in the leg 14. The stop 20 prevents the activator 12 from pressing too strongly against the driver 16 in the event of a strong tensile load on the running rail 8 (FIG. 14A), so that the spring element 13 could deform plastically or the driver 16 could be damaged. Furthermore, the stop 20 can prevent the leg 14 from twisting relative to the leg 15 and thus prevent the activator from deflecting upwards and/or downwards in this case. This lateral fixation becomes particularly clear in the following embodiments with double stop 30.

Figure 15B:
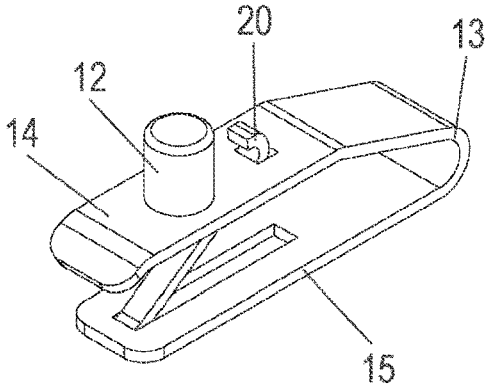

FIG. 15B shows a modified design of the stop 20, which is formed integrally with the leg 15 on a modified web.

Figure 15C:
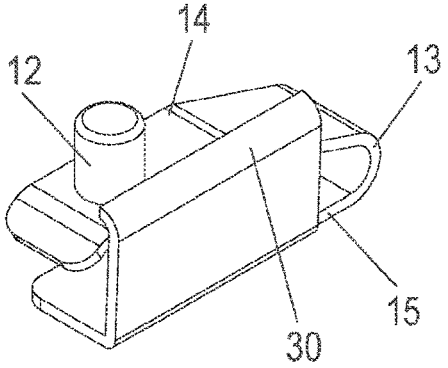
Figure 15D:
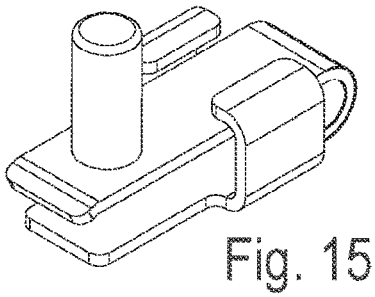
Figure 15E:
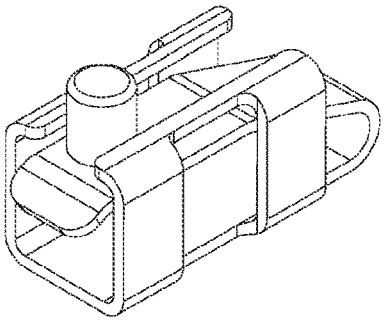
Figure 15F:
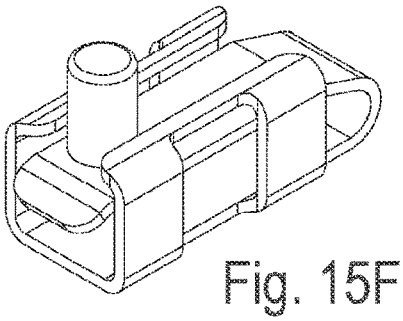
Figure 15G:
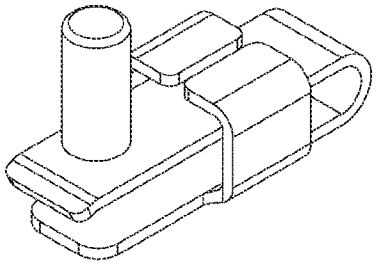
Figure 15H:
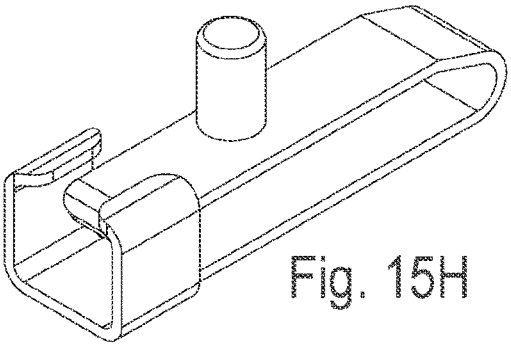
Figure 15I:
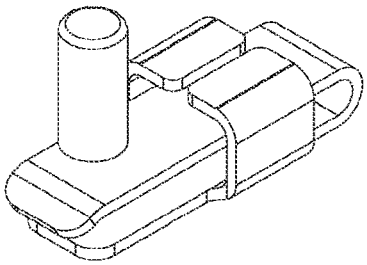
Figure 15J:
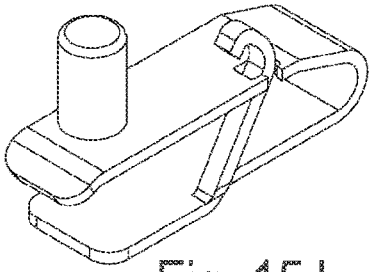
Figure 15K:
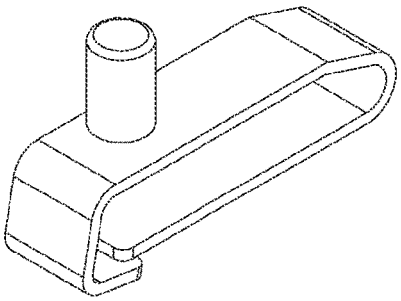
Figure 15L:
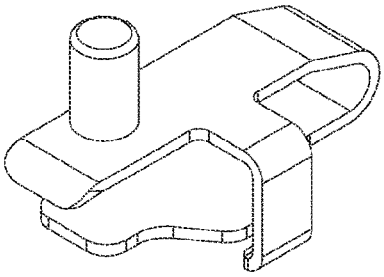

In FIG. 15C, a stop 30 is provided which limits the movement of the leg 14 with the activator 12. The stop 30 is formed integrally with the leg 15 as an angle.

FIGS. 15D to 15L show different embodiments of a U-shaped curved spring element, on each of which at least one integrally formed stop is provided to limit the movement of the activator 12 on the leg 15. The skilled person can realize such a stop in different ways.

Figure 15M:
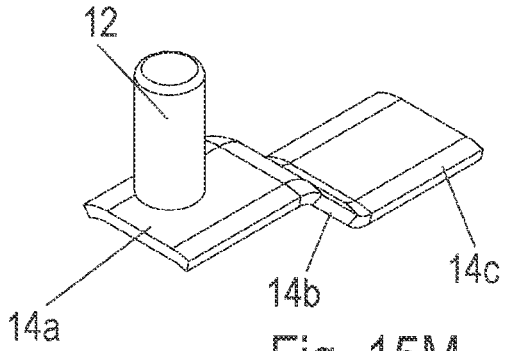
Figure 15N:
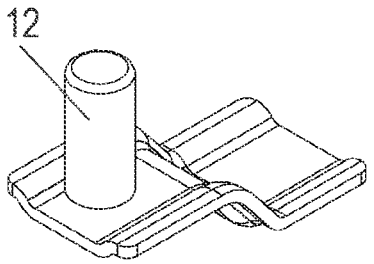
Figure 15O:
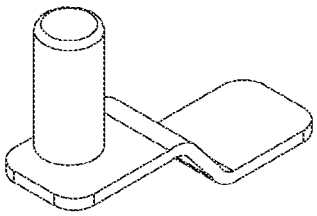
Figure 15P:
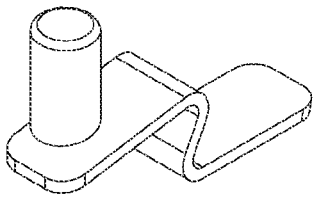
Figure 15Q:
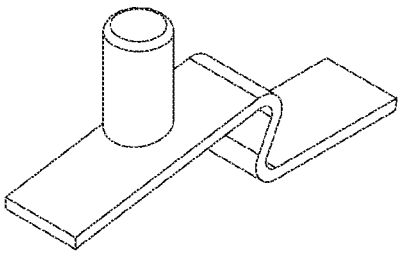
Figure 15R:
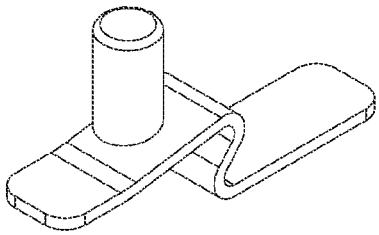
Figure 15S:
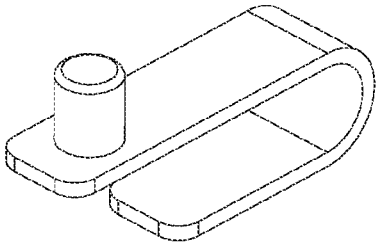
Figure 15T:
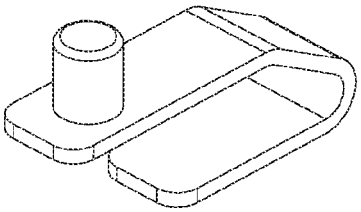

FIG. 15M shows a modified embodiment of a spring element, which is designed as a web and has a first section 14*a* parallel to the longitudinal direction, to which the activator 12 is fixed. A second section 14*b* is inclined to the longitudinal direction, and a third section 14*c* is aligned parallel to the longitudinal direction and fixed to the running rail 8. The section 14*c* is fixed closer to the rear end of the running rail 8 than the activator 12 is arranged in order to cause the activator 12 to be pressed in towards the driver 16 when the running rail 8 is subjected to a tensile load. FIGS. 15N to 15T show variants of a spring element with which this function can also be realized, i.e. with which the activator 12 is pressed against the driver 16 when a tensile load is applied to the running rail.

FIG. 16 shows a modified version of an activator 12 with a spring element 13, which is not fixed to the running rail 8 but to the drawer 3. For this purpose, a holder 40 is provided on the drawer 3, which is U-shaped and in which the U-shaped spring element 13 with the activator 12 is arranged.

FIGS. 17A and 17B show the U-shaped holder 40, in which the spring element 13 with the activator 12 is accommodated. Two dowels 41 are formed on the holder 40, which engage in openings on the drawer 3 in the mounted position. The activator 12 therefore does not have to be fixed directly to the running rail 8, but can also be held on a drawer 3. Alternatively, the spring element can also be attached directly, by gluing or latching and/or by means of other connecting elements to the movable furniture part in a detachable or non-detachable manner.

In the illustrated embodiment example, the driver 16 and the activator 12 are part of a locking system that ensures that only one of the drawers 3 can be in an open position at a time in order to prevent the piece of furniture 1 from tipping. However, it is also possible to use the activator 12 and the driver 16 with a self-closing mechanism or an ejector device. In either case, the activator 12 is resiliently mounted on a spring element 13 in order to reinforce the engagement with the driver 16 in the event of a tensile load.

LIST OF REFERENCE SYMBOLS

1 Piece of furniture
2 Furniture body
3 Drawer
4 Pull-out guide
5 Device
6 Bar
7 Housing
8 Running rail
9 Guide rail
10 Middle rail
11 Hook
12 Activator
13 Spring element
14 Leg
14*a*, 146, 14*c* Section
15 Leg
16 Driver
17 Receptacle
18 Run-up slope
19 Bend
20 Stop
21 Opening
22 Web
30 Stop
40 Holder
41 Dowel
70 Run-up slope

The invention claimed is:

1. A piece of furniture (1) comprising a furniture body (2) and a plurality of movable furniture parts (3), which are guided or held on the furniture body (2) by a device (5) that is configured for holding, braking or accelerating the movable furniture parts, the device (5) comprising:

a strip (6) with several housings (7), each housing having a guide track and being fixed to the furniture body;

a driver (16) disposed in each housing, and being configured to be moved along a guide path in the guide track between at least two end positions, and an activator (12) disposed on each one of the movable furniture parts or on a running rail (8) of a pull-out guide (4) connected to each one of the movable furniture parts, each activator being configured to be brought into engagement with a corresponding one of the drivers (16) at a receptacle (17) in order to hold, brake or accelerate one of the movable furniture parts (3), and is configured to be decoupled from the corresponding driver (16) at one of the two end positions, wherein each activator (12) is movable through a guide in a longitudinal direction and is resiliently mounted in a direction perpendicular to the longitudinal direction via a spring element (13) and is movable along a run-up slope (18) on the corresponding driver (16) in order to latch on the receptacle (17) behind the run-up slope (18), wherein each activator (12) is configured to be pretensioned in an engagement position on the corresponding driver (16) in the event of a force in the longitudinal direction towards the corresponding driver (16).

2. The piece of furniture (1) according to claim 1, wherein with an increasing force in the longitudinal direction on one of the activators (12), the spring element (13) biases the one activator (12) more strongly towards the corresponding driver (16).

3. The piece of furniture (1) according to claim 1, wherein at least one of the activators (12) is configured to be moved from an initial position with a relaxed spring element (13) perpendicular to the longitudinal direction in opposite directions.

4. The piece of furniture (1) according to claim 1, wherein at least one of the spring elements (13) is designed as a leaf spring and at least one leg (14, 15) of the leaf spring extends from at least one of the activators (12) essentially in the longitudinal direction counter to the direction of action of the force in the longitudinal direction.

5. The piece of furniture (1) according to claim 4, wherein the at least one leg (14, 15) has at least one section which is aligned at an angle to the longitudinal direction.

6. The piece of furniture (1) according to claim 1, wherein at least one of the spring elements (13) is web-shaped and/or U-shaped.

7. The piece of furniture (1) according to claim 4, wherein at least one stop (20, 30) is arranged on the at least one spring element (13), which stop limits the deflection of the leg (14) carrying the activator (12) on the spring element (13).

8. The piece of furniture (1) according to claim 7, wherein the at least one stop (20, 30) is formed integrally with the at least one spring element (13).

9. The piece of furniture (1) according to claim 1, wherein at least one of the activators (12) is manufactured in one piece with a corresponding one of the spring elements.

* * * * *